US007194234B2

(12) United States Patent
Katakabe et al.

(10) Patent No.: US 7,194,234 B2
(45) Date of Patent: Mar. 20, 2007

(54) ELECTROMAGNETIC INDUCTION HEAT GENERATING ROLLER, HEATING DEVICE, AND IMAGE FORMING APPARATUS

(75) Inventors: Noboru Katakabe, Uji (JP); Masaru Imai, Hirakata (JP); Keisuke Fujimoto, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 210 days.

(21) Appl. No.: 11/040,873

(22) Filed: Jan. 21, 2005

(65) Prior Publication Data

US 2005/0152720 A1 Jul. 14, 2005

Related U.S. Application Data

(63) Continuation-in-part of application No. 10/480,344, filed as application No. PCT/JP02/11328 on Oct. 31, 2002, now abandoned.

(30) Foreign Application Priority Data

Nov. 1, 2001 (JP) ..... 2001-336321

(51) Int. Cl.
*G03G 15/20* (2006.01)

(52) U.S. Cl. ..... 399/330; 219/216

(58) Field of Classification Search ..... 399/328, 399/330, 333; 219/216, 388, 469, 619, 643
See application file for complete search history.

(56) References Cited

U.S. PATENT DOCUMENTS

| | | | | |
|---|---|---|---|---|
| 4,948,466 | A | 8/1990 | Jaakkola | |
| 5,768,673 | A | 6/1998 | Morigami et al. | |
| 5,832,354 | A | 11/1998 | Kouno et al. | |
| 5,862,445 | A * | 1/1999 | Ogawa et al. | 399/329 |
| 5,915,147 | A | 6/1999 | Kouno et al. | |
| 5,939,337 | A | 8/1999 | Hatakeyama et al. | |
| 6,021,303 | A | 2/2000 | Terada et al. | |
| 6,037,576 | A | 3/2000 | Okabayashi et al. | |
| 6,069,347 | A | 5/2000 | Genji et al. | |
| 6,175,713 | B1 | 1/2001 | Uehara et al. | |
| 6,453,144 | B1 | 9/2002 | Sato | |
| 6,605,802 | B2 | 8/2003 | Nagahira | |
| 6,668,151 | B2 | 12/2003 | Uehara et al. | |
| 6,687,481 | B2 | 2/2004 | Watanabe et al. | |
| 6,810,230 | B2 | 10/2004 | Imai et al. | |

FOREIGN PATENT DOCUMENTS

| | | |
|---|---|---|
| EP | 0 957 412 | 11/1999 |

(Continued)

*Primary Examiner*—Robert Beatty
(74) *Attorney, Agent, or Firm*—Hamre, Schumann, Mueller & Larson, P.C.

(57) ABSTRACT

An electromagnetic induced heating roller comprises a core member, an elastic layer, induction heating layer, and a mold release layer in this order from inside to outside. Further, a magnetic shield layer for preventing a magnetic flux from penetrating into the core member is interposed between the induction heating layer and the core member. The production of an alternating magnetic field from a magnetic field generating device, a leakage flux having penetrated through the induction heating layer is trapped by the magnetic shield layer. As a result, most of the impressed alternating magnetic flux is consumed for heating the heating layer, resulting in an improvement in the heating efficiency. A trouble is prevented which is generated by heating the bearing of the core member.

28 Claims, 9 Drawing Sheets

FOREIGN PATENT DOCUMENTS

| | | |
|---|---|---|
| EP | 1 174 774 | 1/2002 |
| JP | 8-16007 | 1/1996 |
| JP | 9-44015 | 2/1997 |
| JP | 9-80939 | 3/1997 |
| JP | 9-127810 | 5/1997 |
| JP | 10-48976 | 2/1998 |
| JP | 10-74007 | 3/1998 |
| JP | 10-74009 | 3/1998 |
| JP | 10-254263 | 9/1998 |
| JP | 10-319751 | 12/1998 |
| JP | 11-288190 | 10/1999 |
| JP | 2000-206814 | 7/2000 |
| JP | 2001-5315 | 1/2001 |
| JP | 2001-230064 | 8/2001 |
| JP | 2002-93566 | 3/2002 |

* cited by examiner

ELECTROMAGNETIC INDUCTION HEAT GENERATING ROLLER, HEATING DEVICE, AND IMAGE FORMING APPARATUS

This application is a Continuation-in-Part of U.S. patent application Ser. No. 10/480,344 filed Dec. 9, 2003 now abandoned, which is a National Stage of PCT/JP02/11328 filed on Oct. 31, 2002.

TECHNICAL FIELD

The present invention relates to an electromagnetic induction heat generating roller that generates heat by electromagnetic induction heating for heating a sheet-like material to be heated by making continuous contact with the material to be heated. Further, this invention relates to a heating device for fixing a toner image on a recording material by heating in an image forming apparatus that forms an image using toner by an electrophotographic method or another similar method that is used for copiers, printers and the like. Moreover, this invention relates to an image forming apparatus including such a heating device as a fixing device.

BACKGROUND ART

Description will be made by using as an example a fixing device (heating device) in an image forming apparatus such as an electrophotographic copier, a printer or the like. A fixing device for use in image forming apparatuses is a device that permanently fixes an unfixed toner image on a surface of a recording material by heat. The unfixed toner image has been formed on the recording material using toner formed from a thermally meltable resin or the like. The fixing of the toner image is performed by an appropriate image formation processing method such as electrophotography, electrostatic recording or the like.

As a method used most commonly for such fixing devices, a roller fixing method has been known. In the roller fixing method, a recording material is introduced into a nip part formed by a heating roller that is heated and adjusted so that a predetermined fixing temperature is attained and a pressing roller that is opposed to and is in contact under pressure with the heating roller. At the nip part, the recording material is conveyed while being sandwiched between the rollers so that an unfixed toner image is fixed on a surface of the recording material by heating. As a heat source of a heating roller for use in the roller fixing method, a halogen lamp has been in frequent use.

Meanwhile, in recent years, in response to the demand for a reduction in power consumption and warm-up time, roller heating type devices employing an electromagnetic induction heating method have been proposed. FIG. 11 shows an example of a conventional induction heating fixing device including a heat generating roller that is heated by electromagnetic induction (see, for example, JP11(1999)-288190 A).

In FIG. 11, reference numeral 820 denotes a heat generating roller including a core material 824 made of metal, an elastic layer 823 that is formed from a heat-resistant foam rubber and molded integrally on an outer side of the core material 824, a heat generating layer 821 formed of a metallic tube, and a mold releasing layer 822 provided on an outer side of the heat generating layer 821, which are provided outwardly in this order. Reference numeral 827 denotes a pressing roller that is formed from a heat-resistant resin and has the shape of a hollow cylinder. A ferrite core 826 wound with an excitation coil 825 is placed in an inner portion of the pressing roller 827. The ferrite core 826 applies pressure to the heat generating roller 820 through the pressing roller 827, and thus a nip part 829 is formed. While the heat generating roller 820 and the pressing roller 827 rotate in the respective directions indicated by arrows, a high-frequency current is fed through the excitation coil 825. This causes alternating magnetic fields H to be generated, so that the heat generating layer 821 of the heat generating roller 820 is heated rapidly by electromagnetic induction to a predetermined temperature. While predetermined heating is continued in this state, a recording material 840 is inserted into and passed through the nip part 829. Thus, toner images 842 formed on the recording material 840 are fixed on the recording material 840.

Furthermore, in addition to devices of the above-mentioned roller heating type using the heat generating roller 820 having the induction heat generating layer 821 as shown in FIG. 11, devices of a belt heating type using an endless belt including an induction heat generating layer have been proposed. FIG. 12 shows an example of a conventional induction heating fixing device using an endless belt that is heated by electromagnetic induction (see, for example, JP10(1998)-74007 A).

In FIG. 12, reference numeral 960 denotes a coil assembly as an excitation unit that generates a high-frequency magnetic field. Reference numeral 910 denotes a metal sleeve (heat generating belt) that generates heat under a high-frequency magnetic field generated by the coil assembly 960. The metal sleeve 910 is formed by coating a surface of an endless tube made from a thin layer of nickel or stainless steel with a fluorocarbon resin. An inner pressing roller 920 is inserted in an inner portion of the metal sleeve 910, and an outer pressing roller 930 is placed outside the metal sleeve 910. The outer pressing roller 930 is pressed against the inner pressing roller 920 such that the metal sleeve 910 is interposed between them, and thus a nip part 950 is formed. While the metal sleeve 910, the inner pressing roller 920, and the outer pressing roller 930 rotate in the respective directions indicated by arrows, a high-frequency current is fed through the coil assembly 960. Thus, the metal sleeve 910 is heated rapidly by electromagnetic induction to a predetermined temperature. While predetermined heating is continued in this state, a recording material 940 is inserted into and passed through the nip part 950. Thus, a toner image formed on the recording material 940 is fixed on the recording material 940.

In the above-mentioned conventional induction heating fixing device of the roller heating type shown in FIG. 11, the following problems have been presented. That is, in the case of using a metallic material such as iron, aluminum, a stainless material or the like that is in common use for the core material 824 of the heat generating roller 820, the core material 824 itself generates heat by induction heating due to passing of the alternating magnetic fields H, resulting in a loss of power. Further, the heat generation of the core material 824 leads to the occurrence of problems such as, for example, damage to bearings supporting the core material 824 caused due to a high temperature.

Similarly, in the conventional induction heating fixing device of the belt heating type shown in FIG. 12, the following problems have been presented. That is, in the case where the inner pressing roller 920 is formed of a metallic material such as iron, aluminum, a stainless material or the like, a high-frequency magnetic field generated by the coil assembly 960 reaches the inner pressing roller 920, so that the inner pressing roller 920 generates heat, resulting in a loss of power. Further, the heat generation of the inner pressing roller 920 leads to the occurrence of problems such as, for example, damage to bearings supporting the inner pressing roller 920 caused due to a high temperature.

SUMMARY OF THE INVENTION

It is an object of the present invention to solve the problems with the conventional technique and to provide a heat generating roller for use in an induction heating method that achieves an improvement in heat generation efficiency and allows damage to bearings or the like to be prevented, a heating device using the heat generating roller, and a heating device of the belt heating type also utilizing electromagnetic induction. Further, another object of the present invention is to provide an image forming apparatus that achieves excellent energy efficiency and allows problems occurring in bearings to be reduced.

An electromagnetic induction heat generating roller according to the present invention includes a core material, an elastic layer, an induction heat generating layer, and a mold releasing layer, which are provided outwardly in this order. In the electromagnetic induction heat generating roller, a magnetism shielding layer that prevents entry of magnetic flux into the core material is provided between the induction heat generating layer and the core material.

Furthermore, a first heating device according to the present invention includes the above-mentioned electromagnetic induction heat generating roller according to the present invention, a pressing roller that is in contact under pressure with the electromagnetic induction heat generating roller so as to form a nip part, and a magnetic field generating unit that applies a magnetic field to the induction heat generating layer of the electromagnetic induction heat generating roller so that the induction heat generating layer generates heat by induction. In the first heating device, a material to be heated introduced into the nip part is conveyed under pressure by the electromagnetic induction heat generating roller and the pressing roller so as to be heated continuously.

Furthermore, a second heating device according to the present invention includes an electromagnetic induction heat generating belt having an induction heat generating layer, a supporting roller that is composed of a core material and a heat insulating layer provided on an outer side of the core material and makes contact internally with the electromagnetic induction heat generating belt so that the electromagnetic induction heat generating belt is supported rotatably, a pressing roller that makes contact externally with the electromagnetic induction heat generating belt so that a nip part is formed between the pressing roller and the electromagnetic induction heat generating belt, and a magnetic field generating unit that is disposed outside the electromagnetic induction heat generating belt and applies a magnetic field to the induction heat generating layer so that the induction heat generating layer generates heat by induction. In the second heating device, a material to be heated introduced into the nip part is conveyed under pressure by the electromagnetic induction heat generating belt and the pressing roller so as to be heated continuously. Further, in the supporting roller, a magnetism shielding layer that prevents entry of magnetic flux into the core material is provided on an outer side of the core material.

Moreover, an image forming apparatus according to the present invention includes an image forming unit that forms a toner image on a recording material and the above-mentioned first or second heating device according to the present invention. In the image forming apparatus, the toner image to be fixed formed on the recording material by the image forming unit is fixed on the recording material by the heating device.

DETAILED DESCRIPTION OF THE INVENTION

Figure 1:
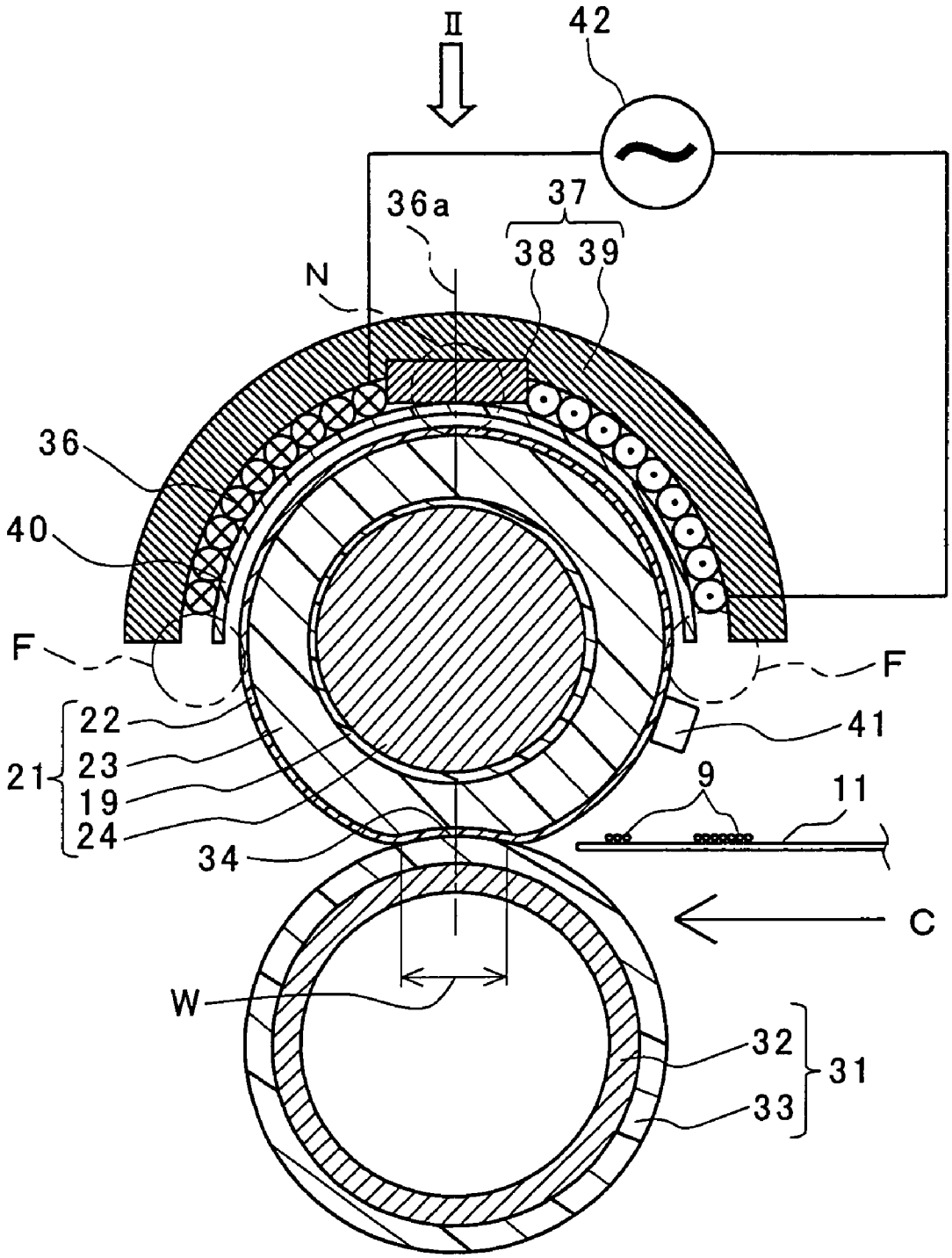
FIG. 1 is a cross sectional view of a heating device according to Embodiment 1 of the present invention.

An electromagnetic induction heat generating roller according to the present invention includes a core material and an induction heat generating layer that is provided on an outer side of the core material. In the electromagnetic induction heat generating roller, a magnetism shielding layer that prevents entry of magnetic flux into the core material is provided between the induction heat generating layer and the core material.

Accordingly, the magnetism shielding layer prevents leakage magnetic flux from reaching the core material, which is magnetic flux that has penetrated the induction heat generating layer from the exterior, and thus the heat generation of the core material is suppressed. As a result, a loss of supplied energy is reduced, and the heat generation efficiency of the induction heat generating layer is increased. Further, it is possible to prevent the occurrence of problems such as, for example, damage to bearings supporting the core material caused due to heating of the bearings to a high temperature.

Preferably, the magnetism shielding layer has a specific resistance of $10^{-3}$ Ωcm or higher.

According to this preferred embodiment, the generation of an eddy current in the magnetism shielding layer can be prevented, and thus the heat generation of the magnetism shielding layer is suppressed. As a result, a loss of supplied energy is reduced, and the heat generation efficiency of the induction heat generating layer is increased.

Preferably, the magnetism shielding layer has a relative magnetic permeability of 10 or higher.

According to this preferred embodiment, it is possible to prevent magnetic flux from penetrating the magnetism shielding layer and then reaching the core material, and thus the generation of heat in the core material further can be suppressed.

Preferably, the magnetism shielding layer has a thickness of not less than 0.2 mm.

According to this preferred embodiment, it is possible to prevent magnetic flux from penetrating the magnetism shielding layer and then reaching the core material, and thus the generation of heat in the core material further can be suppressed.

Preferably, the magnetism shielding layer is a layer of an insulating magnetic material formed on a surface of the core material.

According to this preferred embodiment, a material of the magnetism shielding layer has an insulating property, and thus the generation of an eddy current in the magnetism shielding layer can be prevented. Thus, the generation of heat in the magnetism shielding layer is suppressed. Further, the material of the magnetism shielding layer has magnetism, and thus it is possible to prevent magnetic flux from penetrating the magnetism shielding layer and then reaching the core material. Thus, the generation of heat in the core material further can be prevented.

Preferably, the magnetism shielding layer is composed of a plurality of rings or arc-shaped members that are arranged in rows on a surface of the core material.

According to this preferred embodiment, it is made easier to form the magnetism shielding layer.

The magnetism shielding layer may be the elastic layer in which a magnetic filler is dispersed.

According to this preferred embodiment, the elastic layer functions also as a magnetism shielding layer, and thus a simplified layer configuration can be achieved, and the manufacturing of the electromagnetic induction heat generating roller is made easier, thereby contributing to a cost reduction.

Preferably, the core material is formed from a non-magnetic metal.

According to this preferred embodiment, it is possible to prevent magnetic flux from penetrating the magnetism shielding layer and then entering the core material, and thus the heat generation of the core material further can be suppressed. Further, it is made easier to secure the strength of the core material.

Preferably, the induction heat generating layer has a thickness not larger than a skin depth.

According to this preferred embodiment, the induction heat generating layer has a small thermal capacity and high pliability, and thus an electromagnetic induction heat generating roller that achieves a reduction in warm-up time and has an excellent fixing property can be obtained.

Next, a first heating device according to the present invention is a heating device of the roller heating type and includes the above-mentioned electromagnetic induction heat generating roller according to the present invention, a pressing roller that is in contact under pressure with the electromagnetic induction heat generating roller so as to form a nip part, and a magnetic field generating unit that applies a magnetic field to the induction heat generating layer of the electromagnetic induction heat generating roller so that the induction heat generating layer generates heat by induction.

The above-mentioned first heating device includes the electromagnetic induction heat generating roller according to the present invention. Accordingly, the magnetism shielding layer prevents leakage magnetic flux from reaching the core material, which is magnetic flux that has penetrated the induction heat generating layer from the magnetic field generating unit, and thus the heat generation of the core material is suppressed. As a result, a loss of supplied energy is reduced, and the heat generation efficiency of the induction heat generating layer is increased. Further, it is made possible to prevent the occurrence of problems such as, for example, damage to bearings supporting the core material caused due to heating of the bearings to a high temperature.

Furthermore, a second heating device according to the present invention is a heating device of the belt heating type and includes an electromagnetic induction heat generating belt having an induction heat generating layer, a supporting roller that is composed of a core material and a heat insulating layer provided on an outer side of the core material and makes contact internally with the electromagnetic induction heat generating belt so that the electromagnetic induction heat generating belt is supported rotatably, a pressing roller that makes contact externally with the electromagnetic induction heat generating belt so that a nip part is formed between the pressing roller and the electromagnetic induction heat generating belt, and a magnetic field generating unit that is disposed outside the electromagnetic induction heat generating belt and applies a magnetic field to the induction heat generating layer so that the induction heat generating layer generates heat by induction. Further, in the supporting roller, a magnetism shielding layer that prevents entry of magnetic flux into the core material is provided on an outer side of the core material.

Accordingly, the magnetism shielding layer prevents leakage magnetic flux from reaching the core material, which is magnetic flux that has penetrated the induction heat generating layer from the magnetic field generating unit and then reached the supporting roller, and thus the heat generation of the core material is suppressed. As a result, a loss of supplied energy is reduced, and the heat generation efficiency of the induction heat generating layer is increased. Further, it is made possible to prevent the occurrence of problems such as, for example, damage to bearings supporting the core material caused due to heating of the bearings to a high temperature.

Preferably, in the above-mentioned second heating device, the magnetism shielding layer is formed on a surface of the supporting roller. This allows the realization of a simplified layer configuration and a cost reduction of the supporting roller.

Next, an image forming apparatus according to the present invention includes an image forming unit that forms a toner image on a recording material and the above-mentioned first or second heating device according to the present invention.

Thus, an image forming apparatus can be obtained that achieves a reduction in power consumption and allows problems occurring in bearings can be suppressed.

Hereinafter, the present invention will be described in further detail with reference to appended drawings.

Embodiment 1

Figure 5:
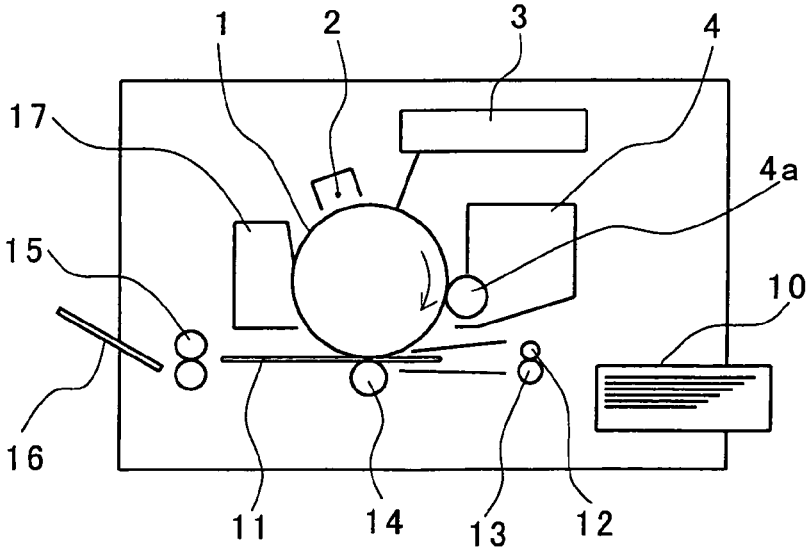
FIG. 5 is a cross sectional view schematically showing a configuration of an image forming apparatus according to an embodiment of the present invention.

FIG. 5 is a cross sectional view of an image forming apparatus using a heating device according to an embodiment of the present invention as a fixing device. The heating device according to this embodiment is an electromagnetic induction heating device of the roller heating type. The following description is directed to the configuration and operation of this device.

Reference numeral 1 denotes an electrophotographic photoreceptor (hereinafter, referred to as a "photosensitive drum"). The photosensitive drum 1, while being driven to rotate at a predetermined peripheral velocity in a direction indicated by an arrow, has its surface charged uniformly to a predetermined potential by a charger 2. Reference numeral 3 denotes a laser beam scanner that outputs a laser beam modulated in accordance with a time-series electric digital pixel signal of image information input from a host device such as an image reading apparatus, a computer or the like, which is not shown in the figure. The surface of the photosensitive drum 1 charged uniformly as described above is scanned by and exposed to this laser beam selectively. This allows a static latent image corresponding to the image information to be formed on the surface of the photosensitive drum 1. Next, the static latent image is supplied with powdered toner charged by a developer 4 having a developing roller 4*a* that is driven to rotate, and made manifest as a toner image.

Meanwhile, a recording material 11 is fed one at a time from a paper feeding part 10 and passed between a pair of resist rollers 12 and 13. Then, the recording material 11 is conveyed to a nip part composed of the photosensitive drum 1 and a transferring roller 14 that is in contact with the photosensitive drum 1, and the timing thereof is appropriate and synchronized with the rotation of the photosensitive drum 1. By the action of the transferring roller 14 to which a transfer bias is applied, toner images on the photosensitive drum 1 are transferred one after another to the recording material 11. The recording material 11 that has been passed through the nip part (transferring part) is released from the photosensitive drum 1 and introduced to a fixing device 15 where fixing of the transferred toner image is performed. The recording material 11 on which the image is fixed by the fixing process is output to a paper ejecting tray 16. The surface of the photosensitive drum 1 from which the recording material has been released is cleaned by removing residual materials such as toner remaining after the transferring process by a cleaning device 17 and used repeatedly for successive image formation.

Next, the embodiment of the heating device according to the present invention that can be used as the above-mentioned fixing device 15 will be described in detail by way of an example.

Figure 2:
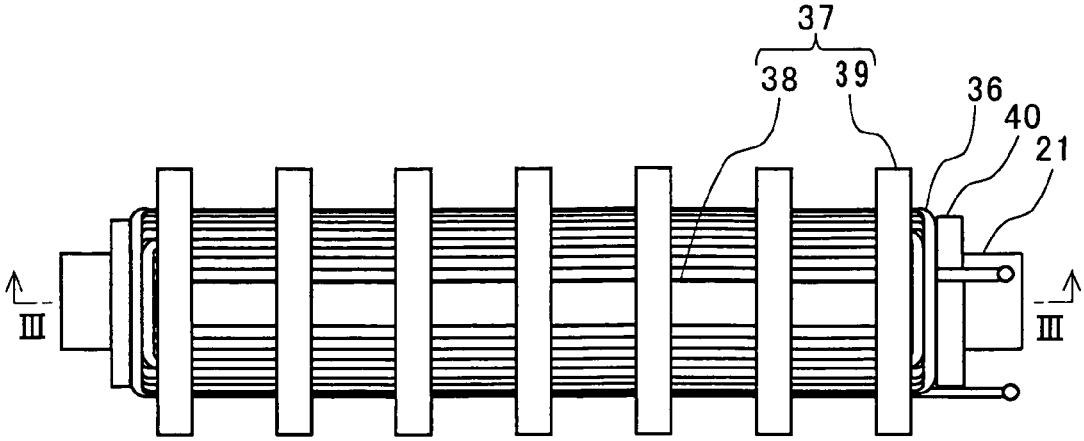
FIG. 2 is a structural view of a magnetic field generating unit as seen from a direction indicated by an arrow II of FIG. 1.
Figure 3:
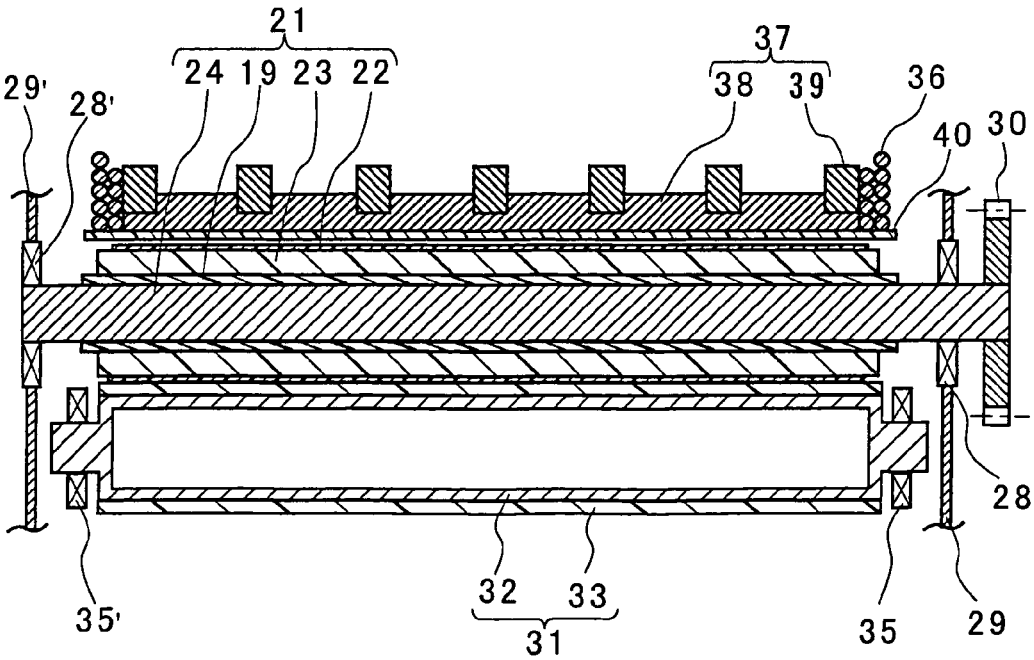
FIG. 3 is a cross sectional view taken on line III—III of FIG. 2 for showing the heating device according to Embodiment 1 of the present invention.
Figure 4A:
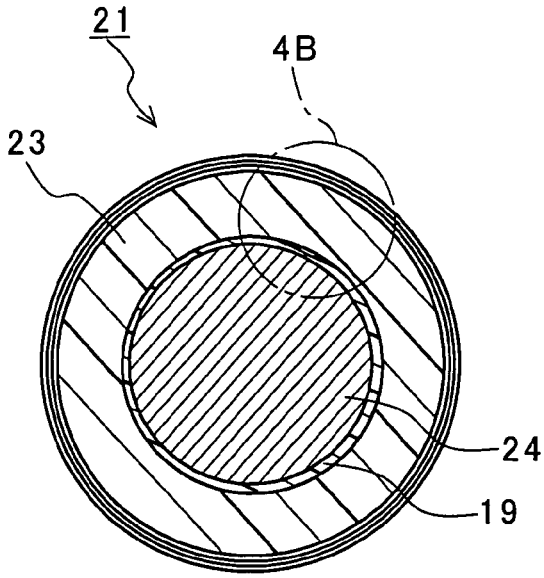
FIG. 4A is a cross sectional view of a heat generating roller according to Embodiment 1 of the present invention that is used in a fixing device shown in FIG. 1.
Figure 4B:
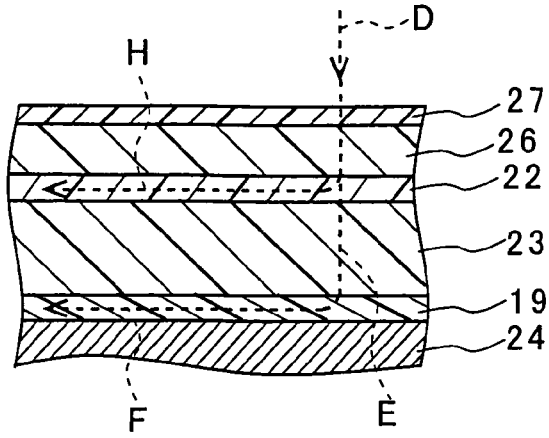
FIG. 4B is an expanded sectional view of a portion 4B shown in FIG. 4A.

FIG. 1 is a cross sectional view of a fixing device as the heating device according to Embodiment 1 of the present invention that is used in the above-mentioned image forming apparatus. FIG. 2 is a structural view of a magnetic field generating unit as seen from a direction indicated by an arrow II of FIG. 1. FIG. 3 is a perspective sectional view taken on line III—III (a plane including a rotation center axis of a heat generating roller 21 and a winding center axis 36*a* of an excitation coil 36) of FIG. 2. FIG. 4A is a sectional structural view of the heat generating roller 21 according to the present invention that is used in the fixing device shown in FIG. 1. FIG. 4B is an expanded sectional view of a portion 4B shown in FIG. 4A. The following description is directed to the fixing device and the heat generating roller according to this embodiment with reference to FIGS. 1 to 4B.

In FIGS. 4A and 4B, the heat generating roller 21 is composed of a mold releasing layer 27, a thin elastic layer (second elastic layer) 26, an induction heat generating layer (hereinafter, referred to simply as "heat generating layer") 22 that is formed of a thin conductive material, an elastic layer 23 that has an excellent heat insulating property, a magnetic body layer 19 as a magnetism shielding layer, and a core material 24 that is to function as a rotary shaft, which are provided in this order from a surface side.

FIG. 3 is a perspective sectional view taken on line III—III of FIG. 2 and shows a configuration of the whole fixing device as seen in cross section from a lateral direction. The heat generating roller 21 has an outer diameter of 30 mm and is supported rotatably by side plates 29, 29' via bearings 28, 28' at both ends of the core material 24 that is the lowest layer thereof. The heat generating roller 21 is driven to rotate by a driving unit of a main body of the apparatus, which is not shown in the figure, through a gear 30 fixed integrally to the core material 24.

Reference numeral 36 denotes the excitation coil as the magnetic field generating unit. The excitation coil 36 is disposed so as to be opposed to a cylindrical face on an outer periphery of the heat generating roller 21. Further, the excitation coil 36 includes nine turns of a wire bundle composed of 60 wires of a copper wire with its surface insulated, which has an outer diameter of 0.15 mm.

The wire bundle of the excitation coil 36 is arranged, at end portions of the cylindrical face of the heat generating roller 21 in a direction of the rotation center axis (not shown in the figure), in the form of an arc along outer peripheral faces of the end portions. The wire bundle is arranged, in a portion other than the end portions, along a direction of a generatrix of the cylindrical face. Further, as shown in FIG. 1, which is a cross section orthogonal to the rotation center axis of the heat generating roller 21, the wire bundle of the excitation coil 36 is arranged tightly without being overlapped (except at the end portions of the heat generating roller) on an assumed cylindrical face formed around the rotation center axis of the heat generating roller 21 so as to cover the cylindrical face of the heat generating roller 21. Further, as shown in FIG. 3, which is a cross section including the rotation center axis of the heat generating roller 21, in portions opposed to the end portions of the heat generating roller 21, the wire bundle of the excitation coil 36 is overlapped in two rows and thus forced into bulges. Thus, the whole excitation coil 36 is formed into a saddle-like shape. The winding center axis 36*a* of the excitation coil 36 is a straight line substantially orthogonal to the rotation center axis of the heat generating roller 21, which passes through substantially a center point of the heat generating roller 21 in the direction of the rotation center axis. The excitation coil 36 is formed so as to be substantially symmetrical with respect to the winding center axis 36*a*. The wire bundle is wound so that adjacent turns of the wire bundle are bonded to each other with an adhesive applied to their surface, thereby maintaining a shape shown in the figure. The excitation coil 36 is opposed to the heat generating roller 21 at a distance of about 2 mm from the outer peripheral face of the heat generating roller 21. In the cross section shown in FIG. 1, the excitation coil 36 is opposed to the outer peripheral face of the heat generating roller 21 in a large area defined by an angle of about 180 degrees with respect to the rotation center axis of the heat generating roller 21.

Reference numeral 37 denotes a rear core, which together with the excitation coil 36, constitutes the magnetic field generating unit. The rear core 37 is composed of a bar-like central core 38 and a substantially U-shaped core 39. The central core 38 passes through the winding center axis 36*a* of the excitation coil 36 and is arranged parallel to the rotation center axis of the heat generating roller 21. The U-shaped core 39 is arranged at a distance from the excitation coil 36 on a side opposite to that of the heat generating roller 21 with respect to the excitation coil 36. The central core 38 and the U-shaped core 39 are connected magnetically. As shown in FIG. 1, the U-shaped core 39 is of a U shape substantially symmetrical with respect to a plane including the rotation center axis of the heat generating roller 21 and the winding center axis 36*a* of the excitation coil 36. As shown in FIGS. 2 and 3, a plurality of the U-shaped cores 39 described above are arranged at a distance from each other in the direction of the rotation center axis of the heat generating roller 21. In this example, the width of the U-shaped core 39 in the direction of the rotation center axis of the heat generating roller 21 is 10 mm, and seven such U-shaped cores 39 in total are spaced at a distance of 26 mm from each other. The U-shaped cores 39 capture magnetic flux from the excitation coil 36, which leaks to the exterior.

As shown in FIG. 1, both ends of each of the U-shaped cores 39 are extended to areas that are not opposed to the excitation coil 36, so that opposing portions F are formed, which are opposed to the heat generating roller 21 without the excitation coil 36 interposed between them. Further, the central core 38 is opposed to the heat generating roller 21 without the excitation coil 36 interposed between them and protrudes further than the U-shaped core 39 to a side of the heat generating roller 21 to form an opposing portion N. The opposing portion N of the protruding central core 38 is inserted into a hollow portion of a winding center of the excitation coil 36. The central core 38 has a cross-sectional area of 4 mm by 10 mm.

In this example, the rear core 37 was formed from ferrite. As a material of the rear core 37, it is desirable to use a material having high magnetic permeability and a high specific resistance such as ferrite, Permalloy or the like. However, a material having somewhat low magnetic permeability can be used as long as the material is a magnetic material.

Reference numeral 40 denotes a heat insulating member that has a thickness of 1 mm and is formed from a resin having high heat resistance such as PEEK (polyether ether ketones), PPS (polyphenylene sulfide) or the like.

In FIG. 1, a pressing roller 31 as a pressing member is formed of a metal shaft 32 whose surface is coated with an elastic layer 33 of a silicone rubber. The elastic layer has a hardness of 50 degrees (JIS-A). The pressing roller 31 is in contact under pressure with the heat generating roller 21 with a force of about 200 N in total, and thus a nip part 34 is formed. The pressing roller 31 has an outer diameter of 30 mm and a length that is substantially the same as that of the heat generating roller 21, while having an effective length slightly larger than the length of the heat generating layer 22.

At the nip part 34, the elastic layer 23 of the heat generating roller 21 is deformed by compression, and the heat generating layer 22 is pressed with substantially a uniform pressure in a width direction (the direction of the rotation center axis of the heat generating roller 21). The nip part 34 has a width W along a moving direction C of the recording material 11 of about 5.5 mm. Although an extremely large force is applied to the heat generating roller 21 and the heat generating layer 22 on a surface of the heat generating roller 21 is thin, the nip part 34 is formed such that the width W is substantially uniform in the direction of the rotation center axis. This can be achieved because the solid core material 24 bears the pressure through the elastic layer 23, and thus distortion with respect to the rotation center axis is suppressed to a minimal amount. Moreover, at the nip part 34, the heat generating layer 22 and the elastic layer 23 are deformed into the shape of a concave along an outer peripheral face of the pressing roller 31. Therefore, when the recording material 11 comes out of the nip part 34 after passing therethrough, a traveling direction of the recording material 11 is on an increased angle with respect to an outer surface of the heat generating roller 21, thereby achieving an excellent peeling property for the recording material 11.

The pressing roller 31 in this state is supported rotatably by follower bearings 35, 35' at both ends of the metal shaft 32. As a material of the elastic layer 33 of the pressing roller 31, as well as the above-mentioned silicone rubber, heat-resistant resin and heat-resistant rubber such as fluorocarbon rubber, fluorocarbon resin and the like may be used. Further, in order to obtain improved abrasion resistance and mold releasability, a surface of the pressing roller 31 may be coated with a single material or a combination of materials selected from resin and rubber such as PFA (tetrafluoroethylene-perfluoroalkylvinyl ether copolymer), PTFE (polytetrafluoroethylene), FEP (tetrafluoroethylene hexafluoropropylene copolymer) and the like. In order to prevent heat dissipation, it is desirable that the pressing roller 31 be formed of a material having low thermal conductivity.

In FIG. 1, reference numeral 41 denotes a temperature detecting sensor that is in contact with the surface of the heat generating roller 21 so as to detect the temperature of the surface of the heat generating roller 21 at a portion right before entering the nip part 34, and feeds back a result of the detection to a controlling circuit that is not shown in the figure. During operation, this function is used to regulate an excitation power of an excitation circuit 42, and thus a temperature of the surface of the heat generating roller 21 at a portion right before entering the nip part 34 is controlled so as to be 170 degrees centigrade. In this example, in order to achieve the object of reducing a warm-up time, the elastic layer 26 and the mold releasing layer 27 that are provided on an outer side of the heat generating layer 22 as well as the heat generating layer 22 are set so as to have an extremely small thermal capacity.

Using the above-mentioned configuration, while the heat generating roller 21 and the pressing roller 31 are rotated, a high-frequency current at 20 to 50 kHz is fed to the excitation coil 36 by the excitation circuit 42. This causes alternating magnetic flux to flow via the central core 38 and the U-shaped cores 39 that surround the excitation coil 36 and the heat generating layer 22 of the heat generating roller 21 that is opposed to the excitation coil 36. Due to this alternating magnetic flux, an eddy current is generated in the heat generating layer 22, so that a surface temperature of the heat generating roller 21 begins to increase rapidly. The surface temperature of the heat generating roller 21 is detected by the temperature detecting sensor 41 and adjusted to a predetermined temperature of 170° C. Then, the recording material 11 carrying unfixed toner images 9 is inserted into the nip part 34 where the toner images 9 and the recording material 11 are heated successively, so that the toner images 9 are fixed on the recording material 11.

Next, the configuration of the heat generating roller 21 will be described in detail.

In this example, the core material 24 is formed of a non-magnetic stainless material (SUS304) having a diameter of 20 mm. A surface of the core material 24 is coated with the insulating magnetic body layer 19 of about 500 μm thickness as a magnetism shielding layer. The magnetic body layer 19 is formed of a base material of a silicone rubber in which a ferrite powder is dispersed. The material of the core material 24 is not limited to a stainless material, and aluminum and the like also can be used. Further, a magnetic powder to be contained in the magnetic body layer 19 is not limited to a ferrite powder, and a Sendust powder and the like also can be used.

The elastic layer 23 is formed of a foam body of a silicone rubber having low thermal conductivity. In the example, the elastic layer 23 is set to have a thickness of 5 mm and a hardness of 45 degrees (ASKER-C). Although the material of the elastic layer 23 is not limited to a foamed silicone rubber, it is desirable to use a material having a hardness of 20 to 55 degrees (ASKER-C) so that the width W of the nip part 34 is secured with moderate elasticity and that heat diffusion from the heat generating layer 22 is reduced. Further, in the case of not using a foam body, it is desirable, in terms of heat resistance and pliability, to use a material of a silicone rubber having a hardness of not more than 50 degrees (JIS-A).

The heat generating layer 22 of this example is formed on the elastic layer 23 as a coating of 60 μm thickness formed of a base material of a silicone rubber in which scale-like pieces of nickel are dispersed. Alternating magnetic flux generated by the excitation coil 36 passes through the heat generating layer 22 by way of the nickel pieces in the heat generating layer 22. This causes an eddy current to be generated in the nickel pieces, so that the heat generating layer 22 is heated rapidly. In this example, the base material of the heat generating layer 22 was formed from a silicone rubber. However, in place of a silicone rubber, heat-resistant resin or heat-resistant rubber that has pliability such as polyimide resin, fluorocarbon resin, fluorocarbon rubber or the like also can be used. Further, a filler to be dispersed in the base material is not limited to the above-mentioned nickel pieces, and a magnetic metal powder and a non-magnetic metal powder also may be used in the form of a mixture or a laminate of these powders so as to be dispersed in the base material. Particles of such powders may have any of the shapes of a fiber, a sphere, a scale and the like. Needless to say, a filler to be dispersed is required only to be formed of a conductive material through which an eddy current flows due to alternating magnetic flux. In this example, however, particularly, a magnetic metal of nickel was used as a filler. Thus, heating can be performed efficiently because: alternating magnetic flux generated by the excitation coil 36 can be led into the heat generating layer 22; a magnetic resistance of a magnetic circuit formed by a magnetic flux flow around the excitation coil 36 can be reduced; and magnetic flux (leakage magnetic flux) penetrating the heat generating layer 22 and then leaking to another layer can be decreased. It is preferable that the heat generating layer 22 has a thickness of 10 to 200 μm.

The elastic layer (second elastic layer) 26 is provided so as to improve adhesion to the recording material 11. In this example, the elastic layer 26 is formed of a silicone rubber layer having a thickness of 200 μm and a hardness of 20 degrees (JIS-A). The thickness of the elastic layer 26 is not limited to 200 μm, and it is desirable to set the thickness to be in a range of 50 to 500 μm. In the case where the thickness of the elastic layer 26 is too large, due to the thermal capacity that is too large, a longer warm-up time is required. In the case where the thickness of the elastic layer 26 is too small, the effect of providing adhesion to the recording material 11 is deteriorated. The material of the elastic layer 26 is not limited to a silicone rubber, and other types of heat-resistant rubber and hear-resistant resin also can be used. Although the elastic layer 26 is not necessarily provided and a configuration without the elastic layer 26 poses no problem, it is desirable to provide the elastic layer 26 in the case of obtaining a toner image as a color image.

The mold releasing layer 27 can be formed from a fluorocarbon resin such as PTFE (polytetrafluoroethylene), PFA (tetrafluoroethylene-perfluoroalkylvinyl ether copolymer), FEP (tetrafluoroethylene hexafluoropropylene copolymer) or the like. In this example, the mold releasing layer 27 was set to have a thickness of 30 μm.

The heat generating roller 21 used in this example is formed by the following manufacturing method. That is, after the elastic layer 23 is formed by foam-molding (it is preferable that the elastic layer 23 has a skin layer on its surface), on the elastic layer 23, a coating of an undiluted liquid of a silicone rubber in which a conductive filler is dispersed is applied in a predetermined thickness by a spray method, a dipping method or the like. Then, the coating is subjected to vulcanization, and thus the heat generating layer 22 is formed on the elastic layer 23. In this case, the core material 24 with the magnetic body layer 19 may be bonded fixedly to the elastic layer 23 before the formation of the heat generating layer 22. Further, the core material 24 with the magnetic body layer 19 may be inserted into and bonded to an inner portion of the elastic layer 23 after the formation of the heat generating layer 22. Further, it also is possible to form the elastic layer 23 by molding directly on the magnetic body layer 19 of the core material 24. Further, the heat generating layer 22 may be formed of a plurality of coatings. After the heat generating layer 22 is formed on the elastic layer 23, in the same manner that the heat generating layer 22 is formed, coatings of a silicone rubber that is used for the elastic layer (second elastic layer) 26 are applied on the heat generating layer 22. Then, the coatings are subjected to vulcanization. After that, the mold releasing layer 27 is formed by, for example, the following method. That is, a PFA tube is fitted around the elastic layer 26 and then is bonded thereto through a primer layer, or the elastic layer 26 is coated with PTFE and then a body thus obtained is subjected to sintering. Between the layers in each pair of the adjacent layers, a primer layer selected so as to correspond to the materials of the layers may be interposed. Further, as in the above-mentioned case, also in the case of using a polyimide resin for the base material of the heat generating layer 22, the heat generating layer 22 is formed by applying a coating of a polyimide varnish on the elastic layer 23.

The description is directed to the operation of the above-mentioned heating device according to Embodiment 1. During the operation of the excitation coil 36, alternating magnetic flux D is generated in such a manner as to flow around the excitation coil 36. Most of the alternating magnetic flux D passes through the heat generating layer 22 as indicated by a broken line H in FIG. 4B. The remaining portion of the alternating magnetic flux D penetrates the heat generating layer 22 as indicated by a broken line E. Due to magnetic flux H passing though the heat generating layer 22, an eddy current is generated in the heat generating layer 22, so that the heat generating layer 22 generates heat. On the other hand, leakage magnetic flux E that has penetrated the heat generating layer 22 heads toward the core material 24. However, since the surface of the core material 24 is coated with the insulating magnetic body layer 19 of about 500 μm thickness that has ferrite, the leakage magnetic flux E is captured by the magnetic body layer 19. Therefore, an amount of magnetic flux entering the core material 24 is decreased considerably. Further, since the magnetic body layer 19 has an insulating property, heat generation due to magnetic flux F passing though the magnetic body layer 19 is not caused in the magnetic body layer 19. Thus, most of the applied alternating magnetic flux D is consumed for the heat generation of the heat generating layer 22, thereby allowing the heat generation efficiency to be increased. Further, the phenomenon in which the core material 24 generates heat due to an eddy current generated therein is prevented. Thus, it also is possible to eliminate problems and the like including damage to the bearings of the core material 24 caused due to heating of the bearings.

It is preferable that the magnetic body layer 19 as the magnetism shielding layer has as high a relative magnetic permeability as possible with respect to the relative magnetic permeability of the core material 24. In this example in which the core material 24 was formed from a non-magnetic metal, with the magnetic body layer 19 having a relative magnetic permeability of about 20 or higher and a thickness of not less than 0.3 mm, a magnetism shielding effect could be attained sufficiently. Generally, the magnetic body layer 19 has a relative magnetic permeability of, preferably 10 or higher, and more preferably 15 or higher. Further, the magnetic body layer 19 has a thickness of, preferably not less than 0.2 mm, and more preferably not less than 0.5 mm.

Furthermore, the magnetic body layer 19 is required not to generate heat due to an eddy current generated when the alternating magnetic flux F passes therethrough. For this reason, it is preferable that the magnetic body layer 19 has an insulating property. However, as long as the magnetic body layer 19 has a specific resistance value of $10^{-3}$ Ωcm or higher, i.e. a value exceeding the range of specific resistance values defining a conductor, practically, the magnetic body layer 19 generates almost no heat and thus is effective.

Furthermore, even in the case where the magnetic body layer 19 is provided, if the core material 24 is formed from a magnetic metal, a portion of the leakage magnetic flux E is likely to enter the core material 24. Therefore, in order to prevent this, it is preferable that the material of the core material 24 is not a magnetic metal such as iron or the like but a non-magnetic metal. Possible examples of a non-magnetic metal include a stainless material, brass, aluminum and the like. Among these materials, particularly, a stainless material is preferred in terms of its strength.

In the above-mentioned embodiment, the heat generating roller 21 has a layer configuration in which the magnetic body layer 19, the elastic layer 23, the heat generating layer 22, the second elastic layer 26, and the mold releasing layer 27 are provided in this order on the core material 24. However, the present invention is not necessarily limited to this layer configuration. The following configurations also are allowable. That is, the respective layers may have a multi-layer configuration. Further, between the respective layers in each pair of the adjacent layers, an adhesive layer may be provided or an auxiliary layer may be formed.

Embodiment 2

Figure 6A:
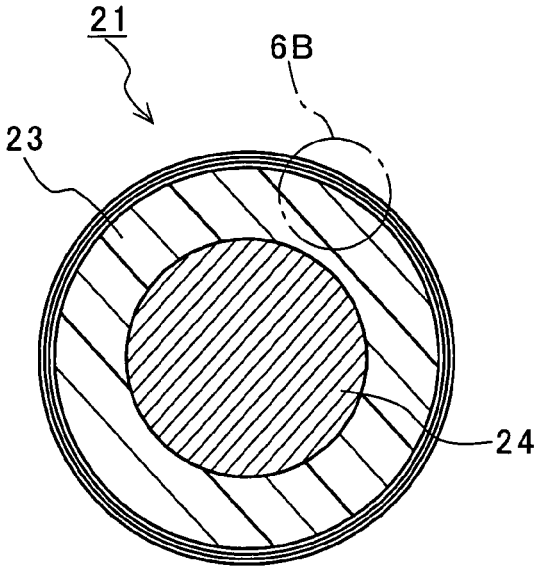
FIG. 6A is a cross sectional view of a heat generating roller according to Embodiment 2 of the present invention that is used in the fixing device shown in FIG. 1.
Figure 6B:
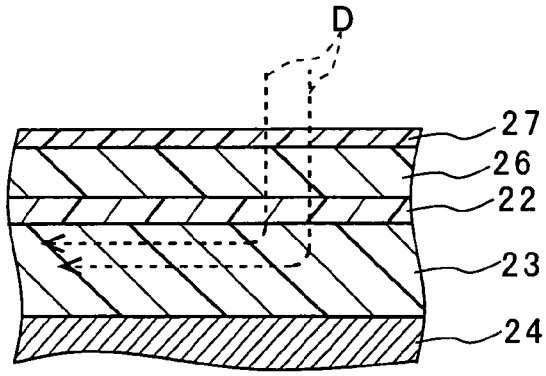
FIG. 6B is an expanded sectional view of a portion 6B shown in FIG. 6A.

The only difference between Embodiment 2 and Embodiment 1 lies in the configuration of the electromagnetic induction heat generating roller 21. FIG. 6A is a cross sectional view of an electromagnetic induction heat generating roller according to Embodiment 2 of the present invention that is used in the image forming apparatus shown in FIG. 5. FIG. 6B is an expanded sectional view of a portion 6B shown in FIG. 6A. In FIGS. 6A and 6B, like reference characters indicate like members that have the same functions as those described with regard to Embodiment 1, for which detailed descriptions are omitted.

A heat generating roller 21 according to this embodiment includes a core material 24, an elastic layer 23, a heat generating layer 22, a second elastic layer 26, and a mold releasing layer 27, which are provided outwardly in this order. As in the case of Embodiment 1, the core material 24 is formed of a non-magnetic stainless material. Unlike the case of Embodiment 1, the heat generating layer 22 is formed of a base material of a silicone rubber in which scale-like particles of a silver powder as a conductive filler are dispersed. Further, the elastic layer 23 is formed from a foamed silicone rubber in which a magnetic powder of ferrite is dispersed. The configuration according to this embodiment does not include the magnetic body layer 19 used in Embodiment 1.

Alternating magnetic flux D generated by an excitation coil 36 penetrates the heat generating layer 22 and then enters the elastic layer 23. Since the elastic layer 23 contains the magnetic powder of ferrite, after passing through the elastic layer 23, the alternating magnetic flux D flows back to a U-shaped core 39 and a central core 38. The alternating magnetic flux D flows around the excitation coil 36 in this manner. Due to the alternating magnetic flux D, an eddy current is generated in the heat generating layer 22, so that the heat generating layer 22 generates heat. Although the core material 24 is formed of a conductive material, since the magnetic flux D is captured by the magnetic powder in the elastic layer 23, only a trace amount of magnetic flux passes through the core material 24. Thus, the core material 24 generates almost no heat. Further, the magnetic powder in the elastic layer 23 has an insulating property, and thus no heat is generated.

As described above, in this embodiment, the elastic layer 23 in which the magnetic powder is dispersed functions as a magnetism shielding layer. This eliminates the need for the magnetic body layer 19 used in Embodiment 1.

Embodiment 3

Figure 7A:
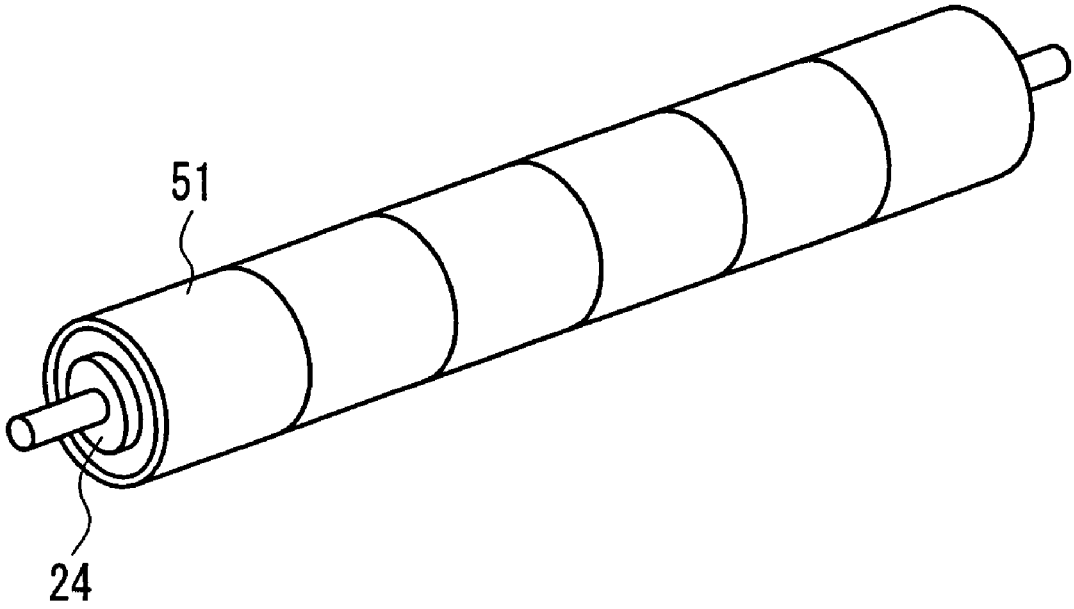
FIG. 7A is a schematic perspective view of a core material of an electromagnetic induction heat generating roller according to Embodiment 3 of the present invention that includes a magnetism shielding layer.

The only difference between Embodiment 3 and Embodiment 1 lies in the configuration of the magnetism shielding layer of the electromagnetic induction heat generating roller 21. FIG. 7A is a schematic perspective view of a core material 24 of an electromagnetic induction heat generating roller according to Embodiment 3 of the present invention. The core material 24 includes a magnetism shielding layer.

Figure 7B:
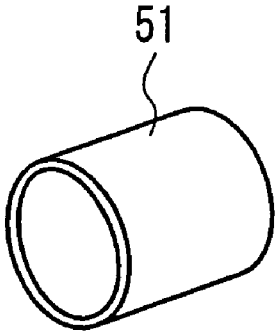
FIG. 7B is a schematic perspective view of a ring forming the magnetism shielding layer of the electromagnetic induction heat generating roller shown in FIG. 7A.

In this embodiment, the magnetism shielding layer is formed by using a ring (hollow cylindrical member) 51 shown in FIG. 7B and is composed of a plurality of the rings 51. The plurality of the rings 51 are fitted externally around the core material 24 and fixed thereto. The ring 51 contains a magnetic material such as ferrite. It is preferable that the adjacent rings 51 are joined to each other. However, the adjacent rings 51 also may be spaced slightly from each other.

Figure 7C:
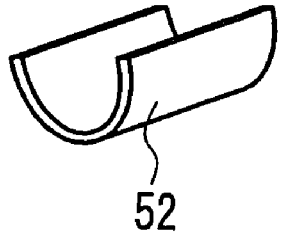
FIG. 7C is a schematic perspective view of an arc-shaped member forming the magnetism shielding layer of the electromagnetic induction heat generating roller shown in FIG. 7A.

In place of the ring 51, an arc-shaped member 52 shown in FIG. 7C may be attached to an outer surface of the core material 24. The arc-shaped member 52 contains a magnetic material. The member 52 has a shape obtained by dividing the ring 51 into a plurality of pieces in a circumferential direction.

The above-mentioned ring 51 and the arc-shaped member 52 can be manufactured by, for example, a method in which a material containing a magnetic powder is molded into a predetermined shape, and a molded body thus obtained is subjected to sintering.

Furthermore, in place of the ring 51 and the arc-shaped member 52, a sheet-like material containing a magnetic material may be wrapped around the core material 24, or a tube of a pliable magnetic material may be formed and fitted around the core material 24. The above-mentioned flexible sheet or tube can be obtained by dispersing a powder of a magnetic material in a base material of resin or rubber.

As in the case of Embodiment 1, an elastic layer 23, a heat generating layer 22, a second elastic layer 26, and a mold releasing layer 27 are formed on an outer side of the above-mentioned magnetism shielding layer, and thus the heat generating roller 21 according to this embodiment can be obtained.

According to this embodiment, in addition to the effect attained by Embodiment 1, the effect of allowing a magnetism shielding layer to be manufactured more easily can be attained.

Embodiment 4

The only difference between Embodiment 4 and Embodiment 1 lies in the configuration of the heat generating layer 22 of the electromagnetic induction heat generating roller 21. As disclosed in, for example, JP11(1999)-288190 A, a heat generating layer 22 according to this embodiment is formed from a metal such as Ni, Fe, Co, Cu, Cr, stainless steel or the like. Such a metallic material is formed in the shape of an endless belt (tube) of a small thickness (of, for example, 40 μm) and fitted around an outer periphery of an elastic layer 23. In this case, the heat generating layer 22 may be bonded to the elastic layer 23 or also may be just fitted on the elastic layer 23.

Alternating magnetic flux D from a magnetic field generating unit causes an eddy current to be generated in the heat generating layer 22 as in the case of Embodiment 1 and thus allows heat generation to be caused as in the case of Embodiment 1.

According to this embodiment, in addition to the effect attained by Embodiment 1, since the thickness of the heat generating layer 22 can be reduced with relative ease, the effect of allowing a warm-up time to be reduced by decreasing the thermal capacity of the heat generating layer 22 can be attained.

As in this embodiment, in the case where the heat generating layer 22 is formed of an endless belt of metal, it is made relatively easier to reduce a warm-up time by decreasing the thickness of the heat generating layer 22. In this case, however, if the heat generating layer 22 has a thickness not larger than a skin depth, the amount ratio of leakage magnetic flux E penetrating the heat generating layer 22 to the alternating magnetic flux D applied by the magnetic field generating unit is increased in particular. Thus, in the case where a magnetic body layer 19 is not provided, a core material 24 generates heat, and thus the heat generation efficiency of the heat generating layer 22 is decreased considerably. On the other hand, in the case where the magnetic body layer 19 as a magnetism shielding layer is provided between the heat generating layer 22 and the core material 24, a decrease in the heat generation efficiency can be prevented effectively. As described above, the magnetism shielding layer according to the present invention exerts a considerable effect particularly in the case where the heat generating layer 22 has a thickness of not larger than a skin depth. A skin depth (δ) of the heat generating layer 22 is a value that is determined based on a specific resistance (ρ), a magnetic permeability (μ), and a driving frequency (f) and is expressed by $\delta=1/(\pi f\mu\rho)^{1/2}$.

The application of the heat generating layer of a metallic material described with regard to this embodiment is not limited to the application to Embodiment 1 described with regard to the above-mentioned example. The heat generating layer also is applicable to Embodiments 2 and 3, and the same effect as that described above can be attained.

Embodiment 5

Figure 8:
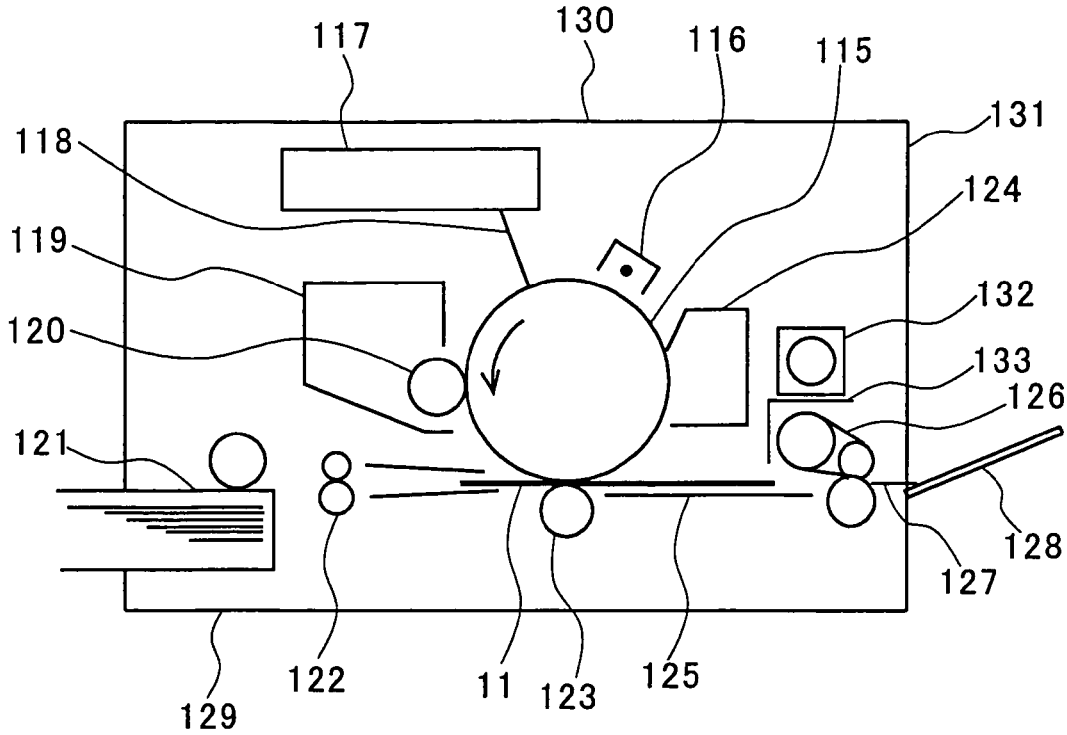
FIG. 8 is a cross sectional view schematically showing a configuration of an image forming apparatus according to another embodiment of the present invention.

FIG. 8 is a cross sectional view of an image forming apparatus using a heating device according to an embodiment of the present invention as a fixing device. The heating device according to this embodiment is an electromagnetic induction heating device of the belt heating type. The following description is directed to the configuration and operation of this device.

In FIG. 8, reference numeral 115 denotes an electrophotographic photoreceptor (hereinafter, referred to as a "photosensitive drum"). The photosensitive drum 115, while being driven to rotate at a predetermined peripheral velocity in a direction indicated by an arrow, has its surface charged uniformly to a negative dark potential V0 by a charger 116. Further, reference numeral 117 denotes a laser beam scanner that outputs a laser beam 118 corresponding to a signal of image information. The charged surface of the photosensitive drum 115 is scanned by and exposed to the laser beam 118. Thus, in an exposed portion of the photosensitive drum 115, an absolute potential value is decreased to a light potential VL, and a static latent image is formed. The latent image is developed with negatively charged toner of a developer 119 and made manifest.

The developer 119 includes a developing roller 120 that is driven to rotate. The developing roller 120 with a thin toner layer formed on its outer peripheral face is opposed to the photosensitive drum 115. A developing bias voltage, whose absolute value is lower than the dark potential V0 of the photosensitive drum 115 and higher than the light potential VL, is applied to the developing roller 120.

Meanwhile, a recording material 11 is fed one at a time from a paper feeding part 121 and passed between a pair of resist rollers 122. Then, the recording material 11 is conveyed to a nip part composed of the photosensitive drum 115 and a transferring roller 123, and the timing thereof is appropriate and synchronized with the rotation of the photosensitive drum 115. Toner images on the photosensitive drum 115 are transferred one after another to the recording material 11 by the transferring roller 123 to which a transfer bias voltage is applied. After the recording material 11 is released from the photosensitive drum 115, an outer peripheral face of the photosensitive drum 115 is cleaned by removing residual materials such as toner remaining after the transferring process by a cleaning device 124 and used repeatedly for successive image formation.

Reference numeral 125 denotes a fixing guide that guides the recording material 11 on which the image has been transferred to a fixing device 126. The recording material 11 is released from the photosensitive drum 115 and conveyed to the fixing device 126 where fixing of the transferred toner image is performed. Further, reference numeral 127 denotes a paper ejecting guide that guides the recording material 11, which has passed through the fixing device 126, to the exterior of the apparatus. The fixing guide 125 and the paper ejecting guide 127 that guide the recording material 11 are formed from a resin such as ABS or a non-magnetic metallic material such as aluminum. The recording material 11 on which the image has been fixed by the fixing process is ejected to a paper ejecting tray 128.

Reference numerals 129, 130, and 131 denote a bottom plate of a main body of the apparatus, a top plate of the main body, and a body chassis, which constitute a unit determining the strength of the main body of the apparatus. These strength members are formed of a material that uses a magnetic material of steel as a base material and is plated with zinc.

Reference numeral 132 denotes a cooling fan that generates airflow in the apparatus. Further, reference numeral 133 denotes a coil cover formed of a non-magnetic material such as aluminum, which is configured so as to cover an excitation coil 36 and a rear core 37 that constitute the fixing device 126.

Next, the heating device according to Embodiment 5 of the present invention that is used as the above-mentioned fixing device 126 will be described in detail by way of an example.

Figure 9:
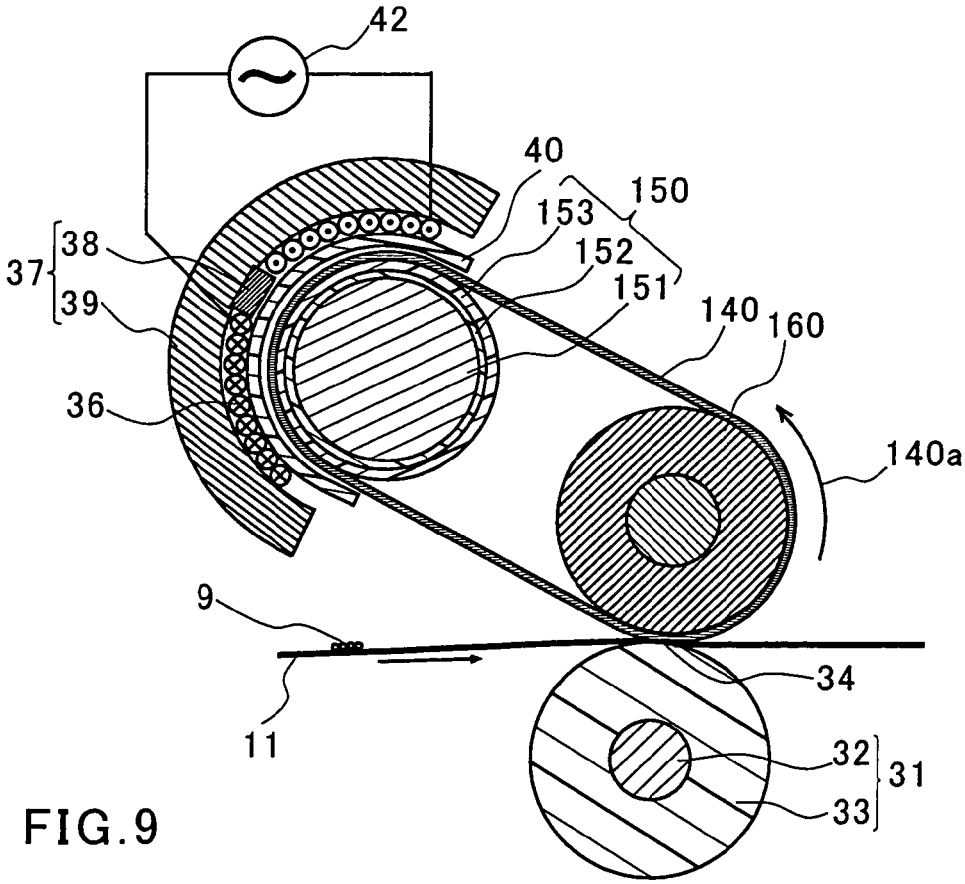
FIG. 9 is a cross sectional view of a heating device according to Embodiment 5 of the present invention.

FIG. 9 is a cross sectional view of a fixing device as the heating device according to Embodiment 5 that is used in the above-mentioned image forming apparatus. In this embodiment, like reference characters indicate like members that have the same functions as those of the heating device according to Embodiment 1, for which duplicate descriptions are omitted. In this embodiment, the respective configurations of a pressing roller 31 and a magnetic field generating unit including and an excitation coil 36, a rear core 37, and a heat insulating member 40 are the same as those described with regard to Embodiment 1.

In FIG. 9, a thin electromagnetic induction heat generating belt (hereinafter, referred to simply as a "heat generating belt") 140 is an endless belt including an induction heat generating layer (hereinafter, referred to simply as a "heat generating layer") of 40 μm thickness that is formed from Ni by electroforming so as to have a belt-like shape. In order to obtain mold releasability, an outer-side surface of the heat generating belt is coated with a 20-μm thick mold releasing layer (not shown) of a fluorocarbon resin. The mold releasing layer also may be formed of a single material or a combination of materials selected from resin and rubber that have excellent mold releasability such as PTFE, PFA, FEP, silicone rubber, fluorocarbon rubber and the like. In the case where the heat generating belt 140 is used for fixing a monochromatic image, it is only required to secure mold releasability. However, in the case where the heat generating belt 140 is used for fixing of a color image, it is desirable to obtain elasticity. In this case, it is preferable that a thick elastic layer further is formed between the heat generating layer and the mold releasing layer.

Reference numerals 150 and 160 denote a supporting roller of 20 mm in diameter and a fixing roller of 20 mm in diameter having low thermal conductivity, respectively. A surface of the fixing roller 160 is coated with a silicone rubber that is an elastic foam body having a low hardness (JIS-A 30 degrees). The heat generating belt 140 is suspended with a predetermined tensile force between the supporting roller 150 and the fixing roller 160. The heat generating belt 140 is allowed to rotate in a direction indicated by an arrow 140*a*. Ribs (not shown) for preventing the heat generating belt 140 from meandering are provided at both ends of the supporting roller 150.

A pressing roller 31 as a pressing member is in contact under pressure with the fixing roller 160 through the heat generating belt 140, so that a nip part 34 is formed between the heat generating belt 140 and the pressing roller 31.

The supporting roller 150 is composed of an elastic layer (heat insulating layer) 153, a magnetic body layer 152, and a core material 151, which are provided inwardly in this order. The core material 151 is formed of a non-magnetic stainless material. The magnetic body layer 152 as a magnetism shielding layer is an insulating layer of about 500 μm thickness coated with a silicone rubber in which a ferrite powder is dispersed. The elastic layer 153 is formed of a foam body of a silicone rubber having low thermal conductivity. In this example, the elastic layer 153 is set to have a thickness of 2 mm and a hardness of 45 degrees (ASKER-C). In order to reduce heat diffusion from the heat generating layer of the heat generating belt 140, it also is effective to form a surface of the elastic layer 153 as an uneven surface so as to reduce a contact area between the elastic layer 153 and the heat generating belt 140.

According to this embodiment, alternating magnetic flux from the magnetic field generating unit causes an eddy current to be generated in the heat generating layer of the heat generating belt 140, so that the heat generating layer generates heat by induction. The heat generating belt 140, which has generated heat, heats the recording material 11 and a toner image 9 formed on the recording material 11 at the nip part 34, so that the toner image 9 is fixed on the recording material 11.

Most of the leakage magnetic flux, i.e. a portion of alternating magnetic flux from the magnetic field generating unit that has penetrated the heat generating layer of the heat generating belt 140 and then entered the supporting roller 150, is captured by the magnetic body layer 152 formed on an outer surface of the core material 151. Therefore, an amount of magnetic flux entering the core material 151 is decreased considerably. Further, heat generation due to magnetic flux passing through the magnetic body layer 152 is not caused in the magnetic body layer 152. Thus, most of the alternating magnetic flux applied by the magnetic field generating unit is consumed for the heat generation of the heat generating layer, thereby allowing the heat generation efficiency to be increased. Further, it also is possible to eliminate problems and the like including damage to bearings of the core material 151 caused due to heating of the bearings.

As for the heat generating layer of the heat generating belt 140 according to this embodiment, the configurations of the heat generating layer 22 of the heat generating roller 21 described above with regard to Embodiments 1 to 4 can be applied thereto, and the same effects as those described with regard to Embodiments 1 to 4 thus can be attained, respectively.

Further, as for the core material 151, the magnetism shielding layer and the elastic layer 153 of the supporting roller 150 according to this embodiment, the respective configurations of the core material 24, the magnetism shielding layer, and the elastic layer 23 of the heat generating roller 21 described above with regard to Embodiments 1 to 4 can be applied thereto, and the same effects as those described with regard to Embodiments 1 to 4 thus can be attained, respectively.

Moreover, this embodiment described a configuration in which the heat generating layer was provided in the heat generating belt 140, and only the heat generating belt 140 was caused to generate heat by induction. However, the same effect can be attained by a configuration in which both of the heat generating belt 140 and the supporting roller 150 are caused to generate heat by induction. That is, an induction heat generating layer is provided as a surface layer of the supporting roller 150 or provided in the vicinity of the surface layer, and a magnetism shielding layer is formed between the induction heat generating layer and the core material 151. For example, if the induction heat generating layer of the supporting roller 150 is formed of a thin pipe formed from an iron alloy such as carbon steel or the like, both of the heat generating belt 140 and the supporting roller 150 are caused to generate heat by induction. In this case, while a warm-up time is increased slightly due to the thermal capacity of the supporting roller 150, the following can be achieved. That is, in the case where the recording materials 11 having a width smaller than a width of the heat generating belt 140 are passed continuously, heat is removed from only a portion of the heat generating belt 140 by the recording materials 11, thereby causing temperature variations in a width direction of the heat generating belt 140. Such temperature variations are reduced by heat transmission in the width direction through the supporting roller 150. Also in this case, since the magnetism shielding layer is provided between the induction heat generating layer and the core material of the supporting roller 150, the heat generation of the core material is prevented.

Furthermore, in this embodiment, the supporting roller 150 does not contribute to the formation of the nip part 34. Therefore, a configuration without the elastic layer 153 is possible. That is, the magnetic body layer 152 can be provided on a surface of the supporting roller 150. This allows the realization of a simplified layer configuration and a cost reduction of the supporting roller 150.

Embodiment 6

A heating device according to Embodiment 6 of the present invention that is used as the fixing device 126 of the image forming apparatus shown in FIG. 8 will be described in detail by way of an example.

Figure 10:
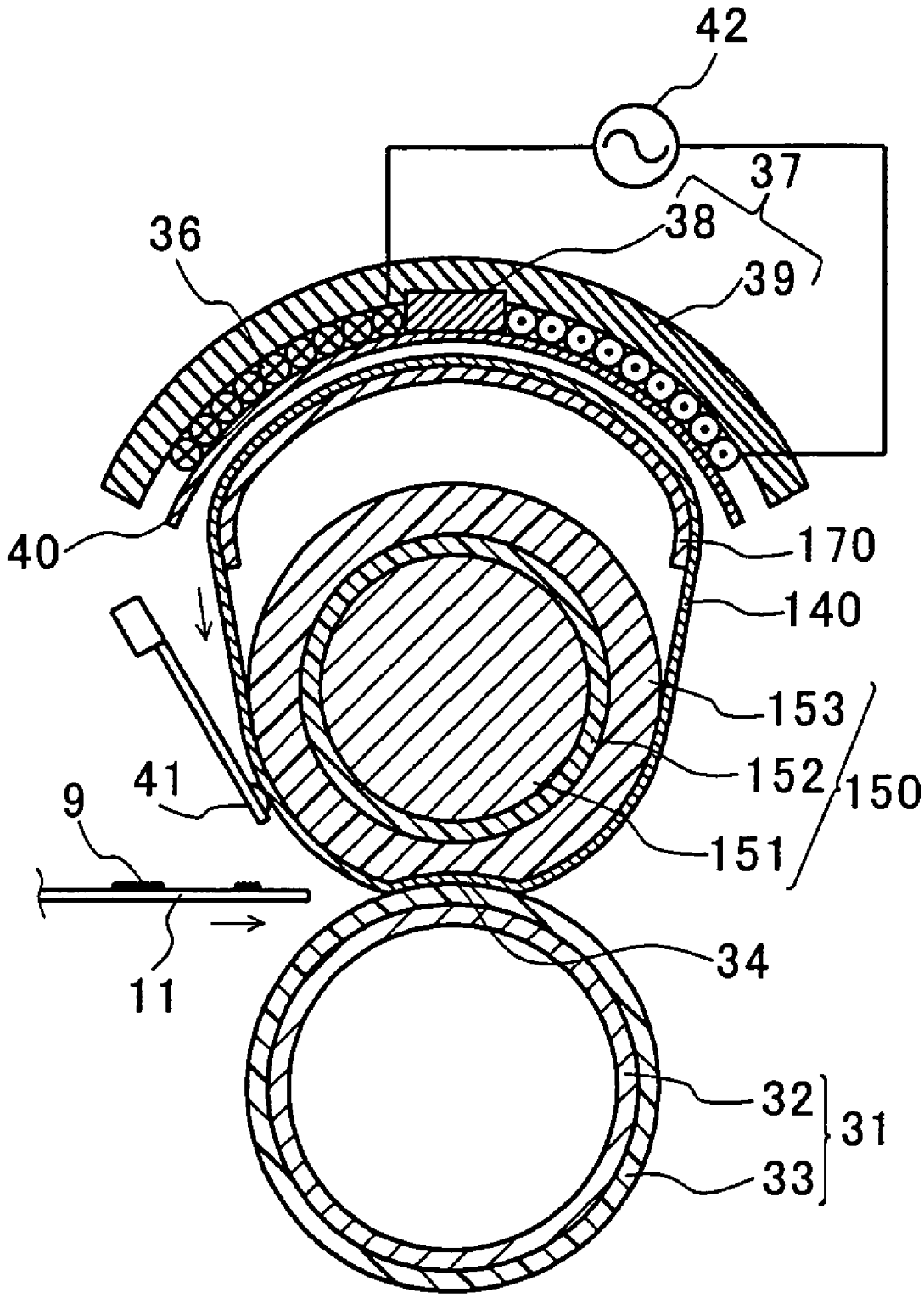
FIG. 10 is a cross sectional view of a heating device according to Embodiment 6 of the present invention.
Figure 11:
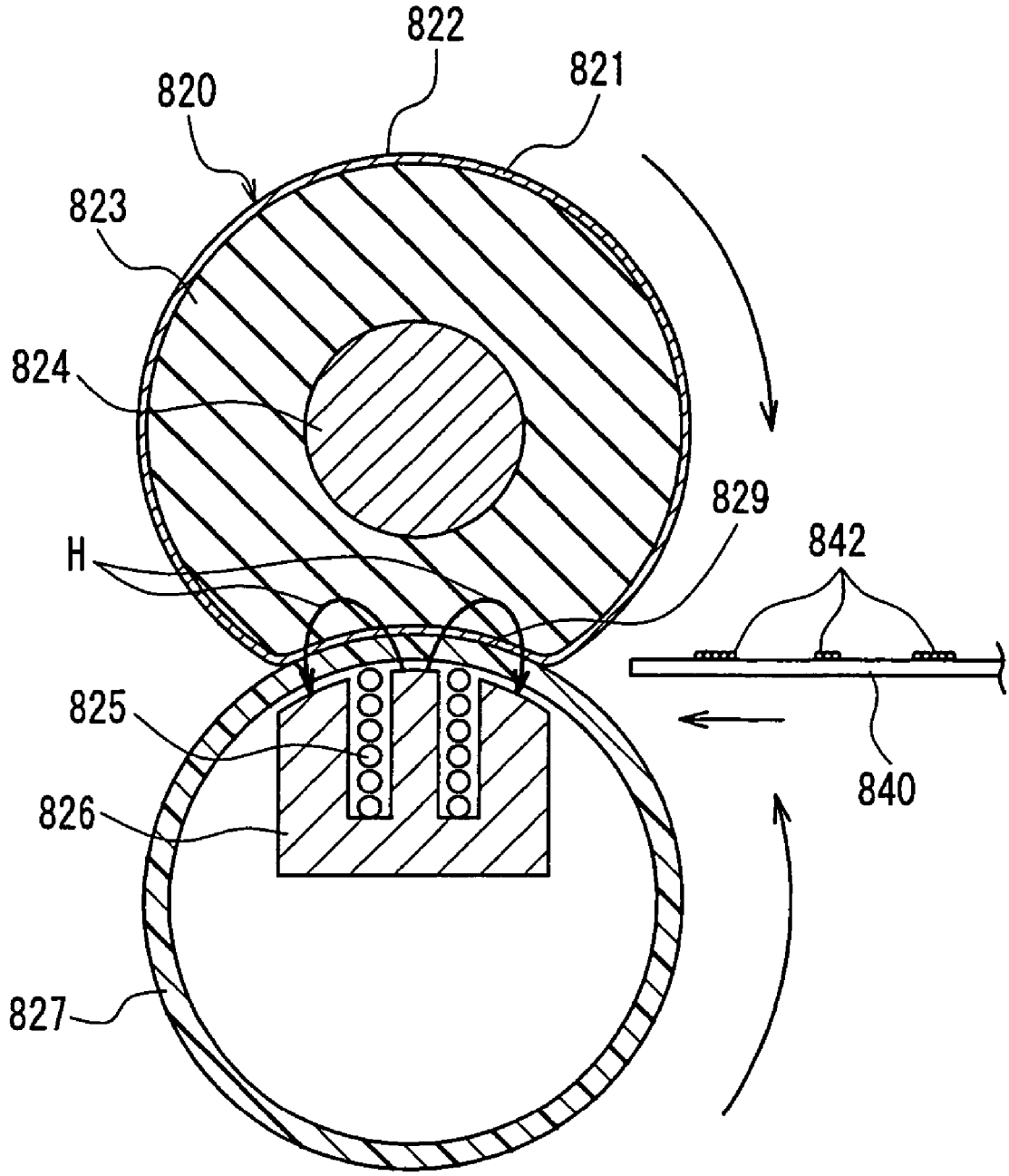
FIG. 11 PRIOR ART
FIG. 11 is a cross sectional view schematically showing a configuration of a conventional induction heating fixing device including a heat generating roller that is heated by electromagnetic induction.
Figure 12:
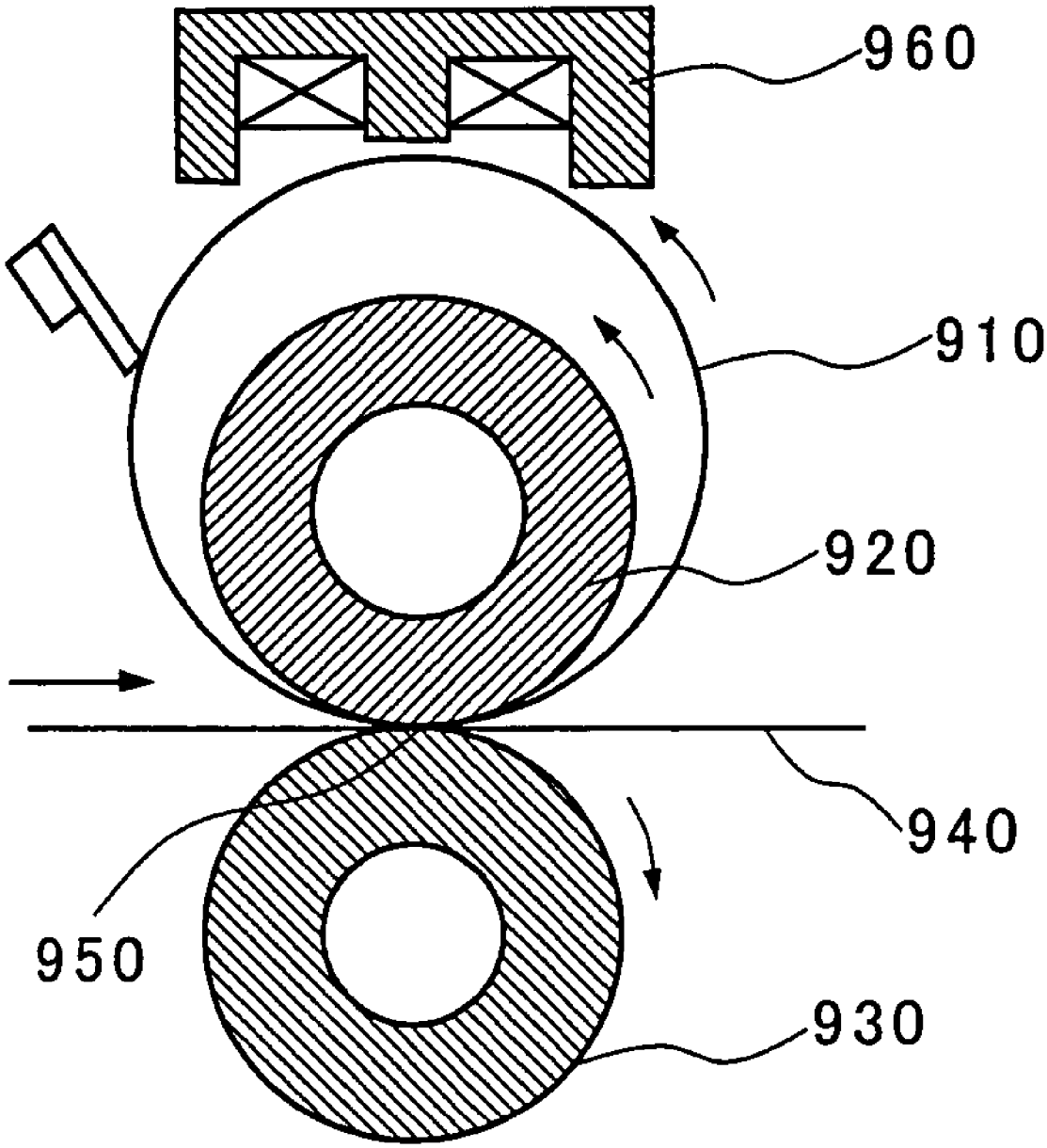
FIG.12 PRIOR ART
FIG. 12 is a cross sectional view schematically showing a configuration of a conventional induction heating fixing device including a heat generating belt that is heated by electromagnetic induction.

FIG. 10 is a cross sectional view of a fixing device as the heating device according to Embodiment 6. In this embodiment, like reference characters indicate like members that have the same functions as those of the heating device according to Embodiment 1, for which duplicate descriptions are omitted. In this embodiment, the respective configurations of a pressing roller 31 and a magnetic field generating unit including an excitation coil 36, a rear core 37 and a heat insulating member 40 are the same as those described with regard to Embodiment 1. Further, an electromagnetic induction heat generating belt (hereinafter, referred to simply as "heat generating belt") 140 and a supporting roller 150 are the same as those described with regard to Embodiment 5.

This embodiment is different from Embodiment 5 in that the heat generating belt 140 is suspended rotatably between the supporting roller 150 and a belt guide 170, and that the supporting roller 150 is in contact under pressure with the pressing roller 31 through the heat generating belt 140. The belt guide 170 is formed of, for example, a resin material having an excellent sliding property.

According to Embodiment 6, as in the case of Embodiment 5, alternating magnetic flux from the magnetic field generating unit causes an eddy current to be generated in a heat generating layer of the heat generating belt 140 so as to cause the heat generating layer to generate heat by induction. The heat generating belt 140, which has generated heat, heats a recording material 11 and a toner image 9 formed on the recording material 11 at a nip part 34, so that the toner image 9 is fixed on the recording material 11.

Leakage magnetic flux, i.e. a portion of alternating magnetic flux from the magnetic field generating unit that has penetrated the heat generating layer of the heat generating belt 140, penetrates the belt guide 170 and then reaches the supporting roller 150. However, most of the leakage magnetic flux that has entered the supporting roller 150 is captured by a magnetic body layer 152 formed on an outer surface of a core material 151. Therefore, an amount of magnetic flux entering the core material 151 is decreased considerably. Further, heat generation due to magnetic flux passing through the magnetic body layer 152 is not caused in the magnetic body layer 152. Thus, most of the alternating magnetic flux applied by the magnetic field generating unit is consumed for the heat generation of the heat generating layer, thereby allowing the heat generation efficiency to be increased. Further, it also is possible to eliminate problems and the like including damage to bearings of the core material 151 caused due to heating of the bearings.

As for the heat generating layer of the heat generating belt 140 according to this embodiment, the configurations of the heat generating layer 22 of the heat generating roller 21 described above with regard to Embodiments 1 to 4 can be applied thereto, and the same effects as those described with regard to Embodiments 1 to 4 thus can be attained, respectively.

Further, as for the core material 151, a magnetism shielding layer, and an elastic layer 153 of the supporting roller 150 according to this embodiment, the respective configurations of the core material 24, the magnetism shielding layer, and the elastic layer 23 of the heat generating roller 21 described above with regard to Embodiments 1 to 4 can be applied thereto, and the same effects as those described with regard to Embodiments 1 to 4 thus can be attained, respectively.

This embodiment described the case of the heating device including the magnetic field generating unit disposed outside a loop of the heat generating belt 140 and the supporting roller 150 disposed inside the loop of the heat generating belt 140, in which the core material of the supporting roller 150 was a metallic member. The present invention, however, is not limited to this configuration but can be applied broadly to any configuration in which a magnetic field generating unit is disposed outside a loop of a heat generating belt and a metallic member is disposed inside the loop of the heat generating belt. For example, as a member for supporting a heat generating belt, a supporting member that includes a metallic member and is not rotatable also can be used in place of the supporting roller. Preferably, the supporting member integrally includes the metallic member, a magnetism shielding member that covers the metallic member so as to prevent entry of magnetic flux into the metallic member, and a heat insulating member that is provided between the metallic member and the heat generating belt. The supporting member is disposed inside a loop of the heat generating belt and presses the heat generating belt against a pressing roller. When the heat generating belt turns in association with the rotation of the pressing roller, the heat generating belt slides on the supporting member.

The embodiments disclosed in this application are intended to illustrate the technical aspects of the invention and not to limit the invention thereto. The invention may be embodied in other forms without departing from the spirit and the scope of the invention as indicated by the appended claims and is to be broadly construed.

The invention claimed is:

1. An electromagnetic induction heat generating roller comprising a core material, an elastic layer, an induction heat generating layer, and a mold releasing layer, which are provided outwardly in this order, wherein a magnetism shielding layer that prevents entry of magnetic flux into the core material is provided between the induction heat generating layer and the core material.

2. The electromagnetic induction heat generating roller according to claim 1, wherein the magnetism shielding layer has a specific resistance of $10^{-3}$ Ωcm or higher.

3. The electromagnetic induction heat generating roller according to claim 1, wherein the magnetism shielding layer has a relative magnetic permeability of 10 or higher.

4. The electromagnetic induction heat generating roller according to claim 1, wherein the magnetism shielding layer has a thickness of not less than 0.2 mm.

5. The electromagnetic induction heat generating roller according to claim 1, wherein the magnetism shielding layer is a layer of an insulating magnetic material formed on a surface of the core material.

6. The electromagnetic induction heat generating roller according to claim 1, wherein the magnetism shielding layer is composed of a plurality of rings or arc-shaped members that are arranged in rows on a surface of the core material.

7. The electromagnetic induction heat generating roller according to claim 1, wherein the magnetism shielding layer is the elastic layer in which a magnetic filler is dispersed.

8. The electromagnetic induction heat generating roller according to claim 1, wherein the core material is formed from a non-magnetic metal.

9. The electromagnetic induction heat generating roller according to claim 1, wherein the induction heat generating layer has a thickness not larger than a skin depth.

10. A heating device, comprising:

an electromagnetic induction heat generating roller as claimed in claim 1;

a pressing roller that is in contact under pressure with the electromagnetic induction heat generating roller so as to form a nip part; and a magnetic field generating unit that applies a magnetic field to the induction heat generating layer of the electromagnetic induction heat generating roller so that the induction heat generating layer generates heat by induction, wherein a material to be heated introduced into the nip part is conveyed under pressure by the electromagnetic induction heat generating roller and the pressing roller so as to be heated continuously.

11. A heating device, comprising:

an electromagnetic induction heat generating belt having an induction heat generating layer;

a supporting roller that is composed of a core material and a heat insulating layer provided on an outer side of the core material and makes contact internally with the electromagnetic induction heat generating belt so that the electromagnetic induction heat generating belt is supported rotatably;

a pressing roller that makes contact externally with the electromagnetic induction heat generating belt so that a nip part is formed between the pressing roller and the electromagnetic induction heat generating belt; and a magnetic field generating unit that is disposed outside the electromagnetic induction heat generating belt and applies a magnetic field to the induction heat generating layer so that the induction heat generating layer generates heat by induction, wherein a material to be heated introduced into the nip part is conveyed under pressure by the electromagnetic induction heat generating belt and the pressing roller so as to be heated continuously, and in the supporting roller, a magnetism shielding layer that prevents entry of magnetic flux into the core material is provided on an outer side of the core material.

12. The heating device according to claim 11, wherein the magnetism shielding layer is formed on a surface of the supporting roller.

13. An image forming apparatus, comprising:

an image forming unit that forms a toner image on a recording material; and a heating device as claimed in claim 10, wherein the toner image to be fixed formed on the recording material by the image forming unit is fixed on the recording material by the heating device.

14. An image forming apparatus, comprising:

an image forming unit that forms a toner image on a recording material; and a heating device as claimed in claim 11, wherein the toner image to be fixed formed on the recording material by the image forming unit is fixed on the recording material by the heating device.

15. A heating device, comprising:

an electromagnetic induction heat generating belt having an induction heat generating layer;

a metallic member that is disposed inside a loop of the electromagnetic induction heat generating belt;

a pressing roller that makes contact externally with the electromagnetic induction heat generating belt so that a nip part is formed between the pressing roller and the electromagnetic induction heat generating belt; and a magnetic field generating unit that is disposed outside the loop of the electromagnetic induction heat generating belt and applies a magnetic field to the induction heat generating layer so that the induction heat generating layer generates heat by induction, wherein a material to be heated introduced into the nip part is conveyed under pressure by the electromagnetic induction heat generating belt and the pressing roller so as to be heated continuously, and a magnetism shielding member that prevents entry of magnetic flux into the metallic member further is provided between the electromagnetic induction heat generating belt and the metallic member.

16. The heating device according to claim 15, wherein the magnetism shielding member is provided so as to cover the metallic member.

17. The heating device according to claim 15, wherein the magnetism shielding member has a relative magnetic permeability higher than a relative magnetic permeability of the metallic member.

18. The heating device according to claim 15, wherein the magnetism shielding member has a relative magnetic permeability of 10 or higher.

19. The heating device according to claim 15, wherein the magnetism shielding member has a relative magnetic permeability of 15 or higher.

20. The heating device according to claim 15, wherein the magnetism shielding member has a thickness of not less than 0.2 mm.

21. The heating device according to claim 15, wherein the magnetism shielding member has a thickness of not less than 0.5 mm.

22. The heating device according to claim 15, wherein the magnetism shielding member has a specific resistance value of $10^{-3}$ Ωm or higher.

23. The heating device according to claim 15, wherein the metallic member is formed from a magnetic metal or a non-magnetic metal.

24. The heating device according to claim 15, wherein a heat insulating member further is provided between the metallic member and the electromagnetic induction heat generating belt.

25. The heating device according to claim 24, wherein the electromagnetic induction heat generating belt is pressed against the pressing roller by the metallic member through the heat insulating member.

26. The heating device according to claim 15, wherein the metallic member is provided in a member that makes contact internally with the electromagnetic induction heat generating belt.

27. The heating device according to claim 26, wherein the member that makes contact internally with the electromagnetic induction heat generating belt is a supporting roller that supports the electromagnetic induction heat generating belt, and the metallic member is a core material of the supporting roller.

28. An image forming apparatus, comprising:

an image forming unit that forms a toner image on a recording material; and a heating device as claimed in claim 15, wherein the toner image to be fixed formed on the recording material by the image forming unit is fixed on the recording material by the heating device.

* * * * *